US005097673A

United States Patent [19]

Negishi

[11] Patent Number: 5,097,673

[45] Date of Patent: Mar. 24, 1992

[54] AIR-CONDITIONED DISPLAY CASE HAVING A WALK-IN SUPPLY ROOM THEREIN

[75] Inventor: Kozaburo Negishi, Isesaki, Japan

[73] Assignee: Sanden Corp., Isesaki, Japan

[21] Appl. No.: 621,617

[22] Filed: Dec. 3, 1990

[30] Foreign Application Priority Data

Dec. 4, 1989 [JP] Japan ..... 1-314656
Nov. 13, 1990 [JP] Japan ..... 2-306648

[51] Int. Cl.[5] ..... A47F 3/04; A47F 3/08
[52] U.S. Cl. ..... 62/256; 312/118
[58] Field of Search ..... 62/255, 256; 211/151, 211/187; 312/118

[56] References Cited

U.S. PATENT DOCUMENTS

| | | | |
|---|---|---|---|
| 2,962,875 | 12/1960 | Barroero | 62/256 |
| 2,984,085 | 5/1961 | Rainwater | 62/256 |
| 3,021,691 | 2/1962 | Jacobs | 62/256 |
| 3,044,274 | 7/1962 | Mathis et al. | 62/256 |
| 3,499,295 | 3/1970 | Brennan | 62/256 X |
| 3,698,205 | 10/1972 | Perez | 62/256 |
| 3,995,925 | 12/1976 | Roesler | 312/118 X |

*Primary Examiner*—William E. Tapolcai
*Attorney, Agent, or Firm*—Hidaka and Benman

[57] ABSTRACT

Air-conditioned display case has two separate inside rooms divided by a partition having a plurality of partition members which can be individually opened. One of the two rooms is a display room with a front access opening situated on the front side of the partition for displaying the merchandise therein. Display shelves for displaying merchandise thereon are disposed in the display room extending frontwardly from the partition. The other room is a walk-in supply room situated on the rear side of the partition. Supply shelves are disposed in the supply room extending rearwardly from the partition. The supply room also has a closeable entrance and preliminary storage shelves so that the merchandise can be brought into the supply room by a work personnel through the entrance and can be preliminarily stored therein. The merchandise can further be placed on the supply shelves and, subsequently, slidingly moved onto the display shelves past the partition. The absent states of the merchandise on the display shelves can be detected and, if absent, the merchandise on the corresponding supply shelves can be moved to the display shelves automatically. The display case also includes air passageways having a heat exchanger and air driving fans so as to form aircurtains across the front access opening.

20 Claims, 6 Drawing Sheets

FIG. 9
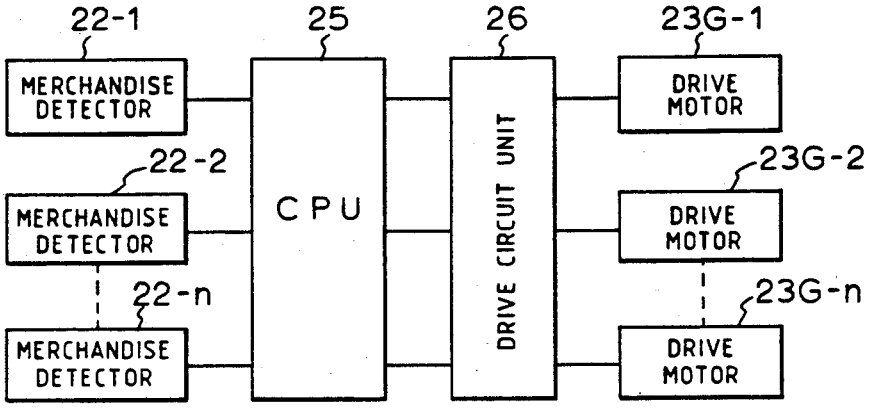
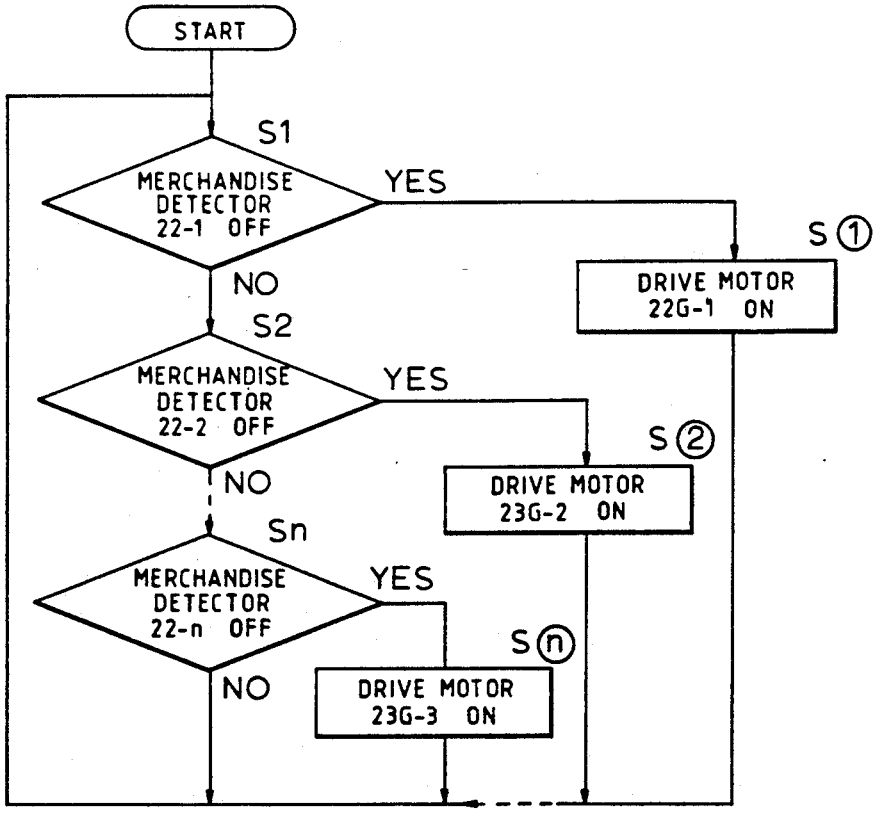
FIG. 10

AIR-CONDITIONED DISPLAY CASE HAVING A WALK-IN SUPPLY ROOM THEREIN

BACKGROUND OF THE INVENTION

1. Field of the Invention

This invention pertains to an air-conditioned display case for keeping and displaying merchandise, namely, perishable foods or the like items, and it relates more particularly to facilitating the supply of the merchandise to the display case.

2. Description of the Prior Art

FIG. 13 shows a conventional refrigerated display case as an example of conventional air-conditioned display cases. A display case 1 has an housing 2 and a separator panel 14 which is disposed inside the housing 2. The housing 2 has an access opening 9 on its front side. A duct 20 is disposed inside the separator panel 14 and the space further inside is a display room 5. Display shelves 4 are disposed in the display room 5 for displaying merchandise 11 thereon. There are an inside air passageway 8A in the duct 20 and an outside air passageway 8B between the housing 2 and the separator panel 14. An evaporator 6 is disposed in a rear section inside the air passageway 8A so that the air passing through the evaporator 6 is refrigerated thereby. A fan 7D and a fan 7E are disposed in the inside and the outside air passageways 8A, 8B, respectively, so as to drive and circulate the air through the respective air passageways and form inside and outside aircurtains 10A, 10B, respectively, across the access opening 9, in the directions shown by the arrows. The temperature of the outside aircurtain 10B is normally between those of the inside aircurtain 10A and the ambient air. The aircurtains 10A, 10B are effective in substantially isolating the refrigerated air in the display room 5 from the ambient air and, therefore, keeping the merchandise 11 on the display shelves 4 under a refrigerated state.

U.S. Pat. No. 3,291,027, for example, discloses a conventional refrigerated display case of this type.

With such a conventional air-conditioned display case as described above, however, the merchandise to be displayed must be supplied always through the front access opening. In that case, a work personnel must convey a supply of merchandise, normally on a cart, to the front of the display case. Therefore, when the store is crowded with shopping customers, moving the cart through the customers or occupying the area in front of the display case by the cart and the work personnel is not only a nuisance to the shopping customers but also an inconvenience to the work personnel himself. Furthermore, in case of a conventional display case, the work personnel has to make a trip to the display case in order to convey a new supply of merchandise every time when any of the display shelves are to be replenished with the merchandise.

SUMMARY OF THE INVENTION

In view of the above described situation, an object of the present invention is to provide an air-conditioned display case to which the merchandise can be supplied without interfering with the shopping customers.

Another object of the present invention is to provide an air-conditioned display case to which the merchandise can be supplied easily, efficiently and without interruption of the supplies.

A further object of the present invention is to provide an air-conditioned display case with which the work personnel may minimize the frequency of his trips in conveying new supplies of merchandise to the display case.

An additional object of the present invention is to provide an air-conditioned display case with which the items placed in its display room at an earlier time sell first.

The air-conditioned display case according to the present invention has an housing, having a front access opening, and a separator panel disposed in the housing substantially evenly spaced therefrom. The display case has an outside air passageway between the housing and the separator panel and an inside air passageway inside the separator panel. The outside and inside air passageways have respective air outlets at the top edge of the access opening and respective air inlets at the bottom edge of the access opening. Fans are provided in the outside and the inside air passageways in order to create forced airflows through the air passageways, thereby forming air curtains, i.e. panels of air flows, across the front access opening. A heat exchanger is disposed in the inside air passageway so as to regulate the temperature of the air passing therethrough and consequently cool down or warm up the interior of the display case.

In order to achieve the above mentioned objects, the inside space of the display case is divided into two separate rooms by a substantially vertical partition having a plurality of partition members, which can be opened individually. One of the two divided rooms is a display room situated on the front side of the partition and the other room is a walk-in supply room situated on the rear side of the partition through which supplies of the merchandise can be provided into the display room. Display shelves for displaying merchandise thereon, spaced vertically and extending from the partition frontwardly, are disposed in the display room. Supply shelves, laterally aligned, vertically spaced, extending rearwardly from the partition, are disposed in the supply room. The supply shelves are for placing additional supplies of the merchandise thereon before the merchandise is moved onto the display shelves past the partition. The supply room has preliminary storage shelves for preliminarily storing the merchandise thereon before it is transferred onto the display shelves via the supply shelves. The supply room has a closeable entrance and can accommodate a work personnel in charge of the supply of the merchandise so that the personnel can enter the room through the entrance and work therein in order to supply merchandise onto the display shelves from the rear side of the display room without hindering any shopping customers that may be present in the front of the display case. The absent states of the merchandise on the display shelves can be detected and the merchandise can be automatically supplied to any empty or underloaded display shelves from the supply shelves.

BRIEF DESCRIPTION OF THE DRAWINGS

FIG. 9 is a block diagram of a control and drive circuit for the drive motors of the supply shelf mechanisms or units shown in FIGS. 7, 11 and 12.

FIG. 10 is a control flow chart for the drive motors of the supply shelf mechanisms of units shown in FIGS. 7, 11 and 12.

DETAILED DESCRIPTION OF THE PREFERRED EMBODIMENTS

Figure 2:
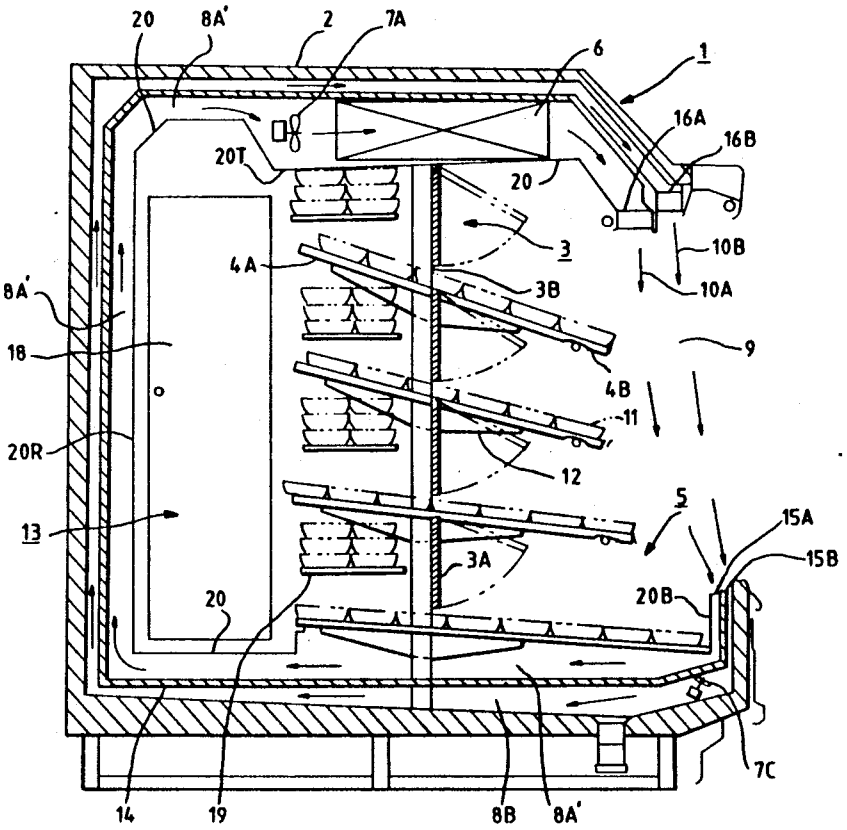
FIG. 2 is a side elevational sectional view of the second embodiment of the display case according to the present invention.

Preferred embodiments of the present invention will now be described in detail in reference to FIGS. 1 to 12. In all of the figures, including FIG. 13 which shows a conventional display case, like reference characters denote like constituent elements.

Figure 1:
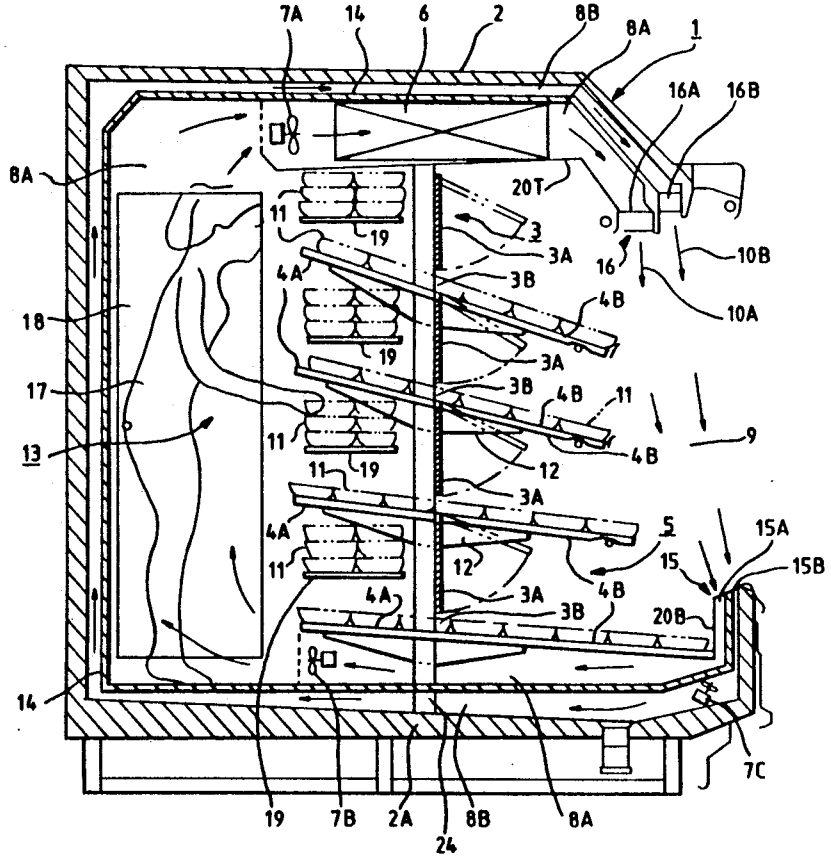
FIG. 1 is a side elevational sectional view of the first embodiment of an air-conditioned display case according to the present invention.

FIG. 1 shows a refrigerated display case as the first embodiment of the air-conditioned display case according to the present invention. A refrigerated display case 1 has a housing 2 and a separator panel 14. The separator panel 14 is disposed inside the housing 2 substantially evenly spaced therefrom. The display case 1 has an access opening 9 on its front side. A partition 3 is disposed substantially vertically inside the housing 2 so as to divide the inside space of the display case 1 into two separate rooms. One room on the front side (the side of the access opening 9) of the partition 3 is a display room 5 having the access opening 9 on the front side thereof. The other room on the rear side of the partition 3 is a supply room 13. The partition 3 includes a support frame 24, which are fixed to a bottom part 2A of the housing 2, and partition members 3A pivotally mounted on the support frame 24.

The display case 1 has an inside air passageway 8A located inside the separator panel 14 and an outside air passageway 8B between the housing 2 and the separator panel 14. In other words, the inside air passageway 8A is situated on the opposite side of the outside air passageway 8B with respect to the separator panel 14 so that the inside and the outside passageways 8A and 8B are isolated from each other by the separator panel 14. At the top section and the bottom section inside the separator panel 14, the inside air passageway 8A is enclosed by a top duct 20T and a bottom duct 20B, respectively. In the rear section inside the separator panel 14 and between the top duct 20T and the bottom duct 20B, the inside air passageway 8A is not enclosed and the supply room 13 serves as a part of the inside air passageway 8A. The outside air passageway 8B is the space between, and defined by, the housing 2 and the separator panel 14 and, therefore, is isolated from both the display room 5 and the supply room 13. An evaporator 6 is disposed in the top duct 20T as a heat exchanger. Fans 7A and 7B are disposed within the top duct 20T and the bottom duct 20B, respectively, of the inside air passageway 8A. Air inlet ports 15A and 15B are disposed on a lower edge 15 of the access opening 9 and serve as the air inlets to the inside air passageway 8A and the outside air passageway 8B, respectively. Air outlet ports 16A and 16B are disposed on an upper edge 16 of the access opening 9 and serve as air exits from the inside air passageway 8A and the outside air passageway 8B, respectively. A fan 7C is disposed in the outside air passageway 8B in the proximity of the air inlet port 15B. The fans 7A and 7B cause a forced air flow which circulates through the inside air passageway 8A (namely, through the air inlet port 15A, the bottom duct 20B, the supply room 13, the top duct 20T, the evaporator 6, the air outlet port 16A) and the access opening 9, as shown by arrows in FIG. 1. The fan 7C causes another forced air flow which circulates through the outside air passageway 8B (namely, through the air inlet port 15B, the outside air passageway 8B and the air outlet port 16B) and the access opening 9, as shown by arrows in FIG. 1. Being refrigerated by the evaporator 6, the air circulating through the inside air passageway 8A forms a panel of refrigerated air, i.e. a refrigerated inside aircurtain 10A, across the air outlet 16A and the air inlet 15A. The air circulating through the outside air passageway 8B forms an outside aircurtain 10B across the air outlet 16B and the air inlet 15B. The temperature of the outside aircurtain 10B is normally between those of the refrigerated inside aircurtain 10A and the ambient air. The aircurtains 10A, 10B effectively keep the refrigerated air inside the display room 5 and the supply room 13 from escaping to the outside through the access opening 9.

Still referring to FIG. 1, numeral 18 denotes an entry door which is disposed on one side of the supply room 13, i.e. in a sidewall (not shown) of the housing 2. The door 18 allows a work personnel 17 to enter the supply room 13 directly from the side of the display case 1. Preliminary storage shelves 19 are disposed in the supply room 13 for preliminarily keeping the merchandise thereon.

In the supply room 13, supply shelves 4A extend rearwardly from the partition 3 in a laterally aligned and vertically spaced arrangement. In the display room 5, display shelves 4B extend frontwardly from the partition 3 in also a vertically spaced arrangement at the respective levels of the supply shelves 4A. In other words, each of the supply shelves 4A is at the level of a corresponding display shelf at which the supply shelf and the display shelf are in alignment. Both the supply shelves 4A and the display shelves 4B are mounted on brackets 12 which are fixedly mounted on the support frame 24. The supply shelves 4A and the respective display shelves 4B are vertically in alignment and slightly descending toward the front of the display case 1. There are no obstructions between the supply shelves 4A and the respective display shelves 4B so that any merchandise 11 placed on the supply shelves 4A can be slid and moved to the respective display shelves 4B by being pushed frontwardly past the partition 3. The display shelves 4B at an even level may be integrated to form a wide display shelf laterally (as viewed from the front of the display case) extending across the sides of the housing 2 (as partly shown in phantom lines in to FIG. 7).

Each of the partition members 3A corresponds to one of the supply shelves 4A. The partition members 3A are pivotally mounted in the top edges thereof on the vertical support frame 24 so that they can be pivotally opened by being pushed frontwardly, as shown in phantom lines in FIG. 1. There are merchandise passing clearances 3B below the bottom edges of the partition members 3A so that items of the merchandise 11 having normal heights can pass through the clearances 3B without opening the respective partition members 3A. However, a design of the partition members 3A may be made so as not to leave the clearances 3B (as shown in phantom lines in FIG. 7). In such case, although the supply room 13 can be normally kept unseen from the shopping customers, the partition members 3A have to be pushed open as the merchandise is moved from the supply shelves 4A to the display shelves 4B.

Next, the function of the refrigerated display case 1 according to the first embodiment of the invention will be described in reference to FIG. 1.

The work personnel 17 conveys a supply of merchandise, namely, perishable foods or the like items, to the side of the display case 1 by using a cart or other conveying means. The personnel will then open the entry door 18 and bring the merchandise into the supply room 13. If and when any of the display shelves 4B need to be replenished with the merchandise, the work personnel 17 will fill the display shelves 4B with the merchandise by first placing the merchandise on the respective supply shelves 4A and pushing and slidingly moving the merchandise 11 forward (frontwardly) to the display shelves 4B. Although the merchandise 11 can normally be pushed forward from the supply shelves 4A to the display shelves 4B through the merchandise passing clearances 3B without opening the corresponding partition members 3A, the work personnel 17 in the supply room 13 may push and open the partition members 3A in order to inspect the condition of the merchandise on the display shelves 3B or in order to reach the merchandise thereon so as to rearrange the merchandise in order. The frontwardly descending arrangement of the supply and the display shelves 4A, 4B, as shown in FIG. 1, facilitates the frontward movements of the merchandise on the shelves by the work personnel 17 because of the gravitational effect. However, either of the supply shelves 4A or display shelves 4B, or both, may alternatively be positioned horizontally. Still alternatively, either or both of the shelves may employ conveyor rollers thereon so as to eliminate the sliding friction of the merchandise, thereby further facilitating the frontward movements of the merchandise thereon.

Any items of the merchandise 11 which have been brought into the display case 1 by the work personnel 17 but have not been placed on the supply shelves 4A or display shelves 4B can be placed on the preliminary storage shelves 19 and kept thereon until it is transferred onto the supply shelves 4A later. Therefore, the work personnel can bring into the display case 1 a large quantity of merchandise at a time and minimize the frequency of his trips to the display case 1. Furthermore, since the supply room 13 is a part of the inside air passageway 8A the air driven by the fans 7A and 7B and refrigerated by the evaporator 6 circulates through the inside air passageway 8A, including the supply room 13, as shown by the arrows in FIG. 1. Consequently, the merchandise 11 placed on the preliminary storage shelves 19 in the supply room 13 is preliminarily refrigerated by the refrigerated air circulating through the inside air passageway 8A. Therefore, the merchandise 11 will be readily refrigerated and suitable for being taken by the shopping customers immediately after it has been transferred from the preliminary storage shelves 19 onto the display shelves 4B via the supply shelves 4A.

A closeable entrance of any suitable design, such as an entrance with a shutter, may be substituted for the entry door 18.

FIG. 2 is a side elevational sectional view of the second embodiment of the refrigerated display case according to the present invention. Since the second embodiment is a partial improvement of the first embodiment, the description will be made only on the improved parts. The substance of the improvement is an addition of a rear duct for the inside air passageway 8A in the supply room 13 shown in FIG. 1.

In reference to FIG. 2, a rear duct 20R is disposed inside the separator panel 14 in the proximity of the rear section thereof and substantially evenly spaced therefrom. The rear duct 20R is connected to the top duct 20T and the bottom duct 20B at the respective ends thereof so that the top duct 20T, rear duct 20R and the bottom duct 20B constitute an integral and continuous duct 20. The interiors of the ducts 20T, 20B and 20R are communicated with one another and form an inside air passageway 8A' for the second embodiment. As opposed to the first embodiment shown in FIG. 1, the supply room 13 in the second embodiment is isolated from the inside air passageway 8A'. Therefore, the work personnel 17 in the supply room 13 will not be directly subjected to the flow of the refrigerated air and will be able to work under a less unpleasant condition. Other parts, their reference characters and their functions of the display case 1 of the second embodiment shown in FIG. 2 are identical to those of the display case 1 of the first embodiment shown in FIG. 1.

Figure 3:
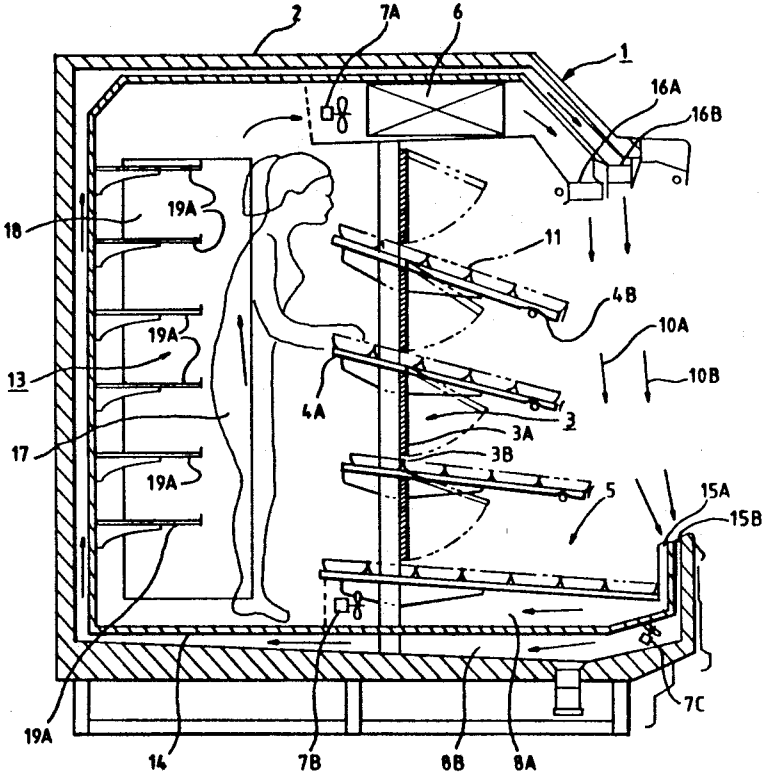
FIG. 3 is a side elevational sectional view of the third embodiment of the display case according to the present invention.

FIG. 3 is a side elevational sectional view of the third embodiment of the refrigerated display case according to the present invention. Since the third embodiment is also a partial improvement of the first embodiment, the description will be made only on the parts improved from the first embodiment. A plurality of preliminary storage shelves 19A are disposed in the rear section of the supply room 13 in a vertically spaced arrangement and horizontally extended to the proximity of the door 18. Therefore, the work personnel 17 can inspect the condition of any merchandise stored on the preliminary storage shelves 19A by simply opening the door 18 from outside the display case 1 without entering the supply room 13. The work personnel 17 can place new supplies of merchandise onto the preliminary storage shelves 19A even from outside the door 18. Thus, the work for supplying merchandise into the display case 1 is substantially facilitated. Other parts, their reference characters and their functions of the display case 1 of the third embodiment shown in FIG. 3 are identical to those of the display case 1 of the first embodiment shown in FIG. 1.

Figure 4:
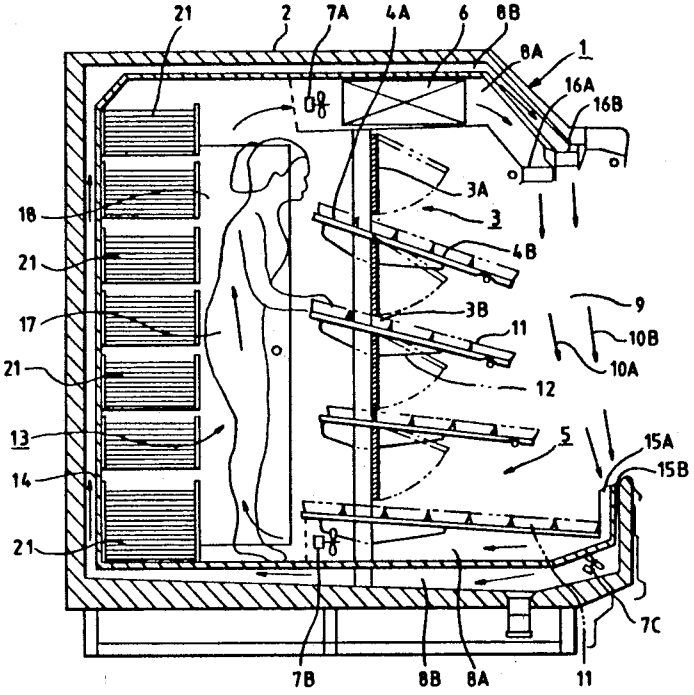
FIG. 4 is a side elevational sectional view of the fourth embodiment of the display case according to the present invention.

Now, the forth embodiment of the refrigerated display case according to the present invention will be described in reference to FIG. 4 and FIG. 5. Since the fourth embodiment is still a partial improvement of the first embodiment, the description will be made only on the parts improved from the first embodiment. Referring to FIG. 4, a plurality of conveyor shelves 21 are disposed in the rear section of the supply room 13 in a vertically spaced arrangement.

Figure 5:
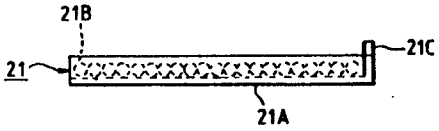
FIG. 5 is a side view of a roller shelf employed in the display case shown in FIG. 4.

FIG. 5 is a side view showing a detail structure of each of the conveyor shelves 21 used in the refrigerated display case 1 shown in FIG. 4. Each of the conveyor shelves 21 has a frame 21A and a plurality of rollers 21B rotatably mounted on the frame 21A in a flat arrangement. Each of the conveyor shelves 21 also has a stopper 21C on and along one end thereof. Each of the conveyor shelves 21 is disposed so that the end thereof having the stopper 21C is placed lower than the other end and that lower end comes close to the door 18. In other words, the conveyer shelves 21 are sloped downwardly toward the door 18. Therefore, the work personnel can see at a glance and inspect any merchandise placed on the conveyor shelves 21 from outside the display case 1 by simply opening the door 18 without entering the supply room 13. Since the merchandise placed on each of the conveyor shelves 21 by the work personnel is by itself conveyed on the sloped conveyor shelf 21 downwardly by the gravitational effect until it is stopped by the stopper 21C, the work personnel will be greatly helped in loading the shelves 21 with the merchandise. Furthermore, when the merchandise is removed from the conveyor shelves 21 so as to be transferred onto the supply shelves 4A, any merchandise remaining on the sloped conveyor shelves 21 gravitationally moves toward the lower ends having the stoppers 21C and, thus, the remaining merchandise will be by itself repositioned orderly to the lower sections on the shelves 21 against the stoppers 21C. This effect eliminates the need of rearrangement of the merchandise on the conveyor shelves 21 by the work personnel.

Figure 6:
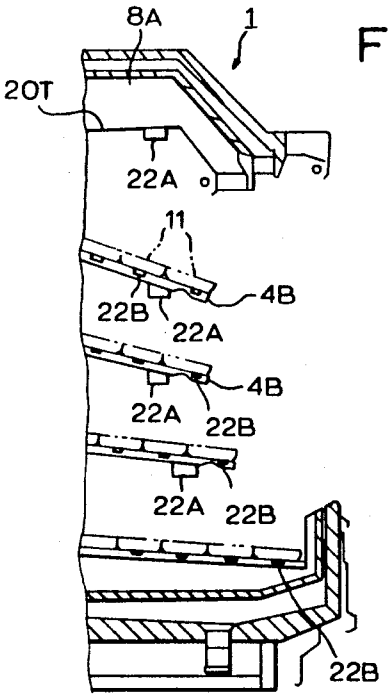
FIG. 6 is a partial side elevational sectional view of the fifth embodiment of the display case, particularly showing merchandise detectors, according to the present invention.

Next, the fifth embodiment of the display case according to the present invention will be described in reference to FIGS. 6 to 10. FIG. 6 shows a partial side elevational sectional view of the fifth embodiment of the display case. Light emitters 22A are mounted on the bottom side of the top duct 20T and the bottom sides of the display shelves 4B, and photosensors 22B are mounted on the display shelves 4B, in such a manner that each of the photosensors 22B is paired with the light emitter 22A directly thereabove. The light emitters 22A emit divergent lights downward so that the respective photosensors 22B detect lights when the merchandise 11 is absent on the respective display shelves 4B. Thus, each pair of the light emitters 22A and the photosensors 22B constitutes a merchandise detector 22 (not reference-numbered in FIG. 6).

Figure 7:
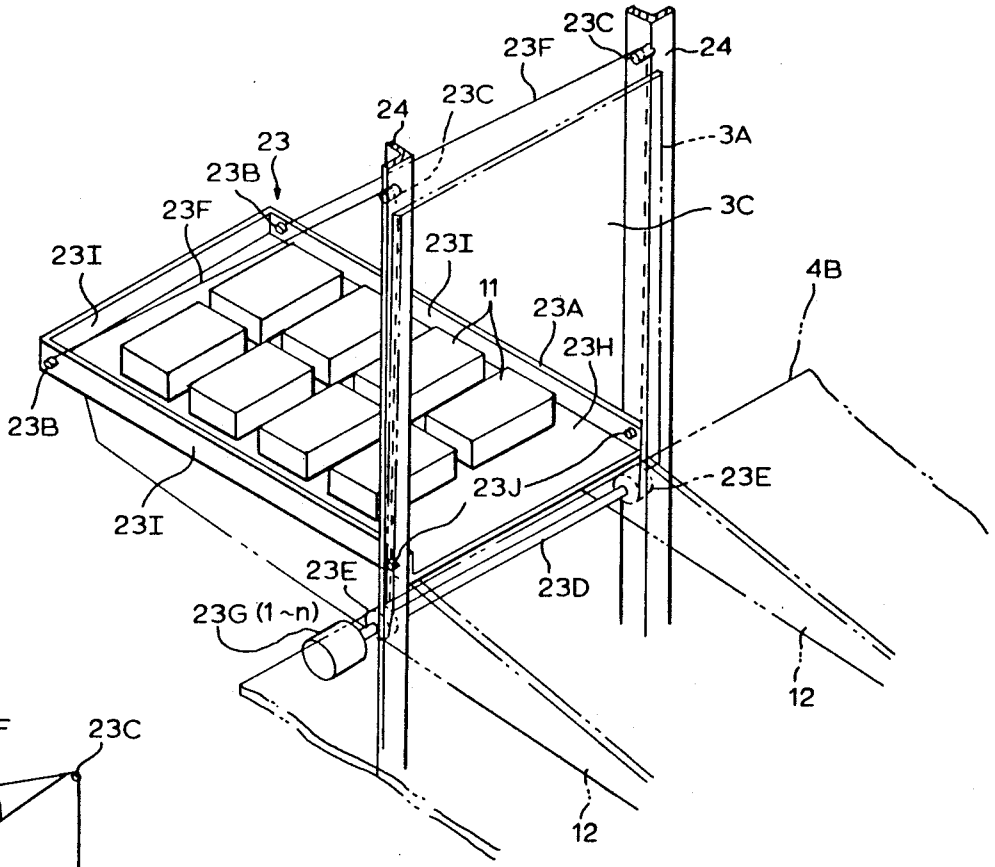
FIG. 7 is a perspective view of a supply shelf mechanism employed in the fifth embodiment of the display case.
Figure 8:
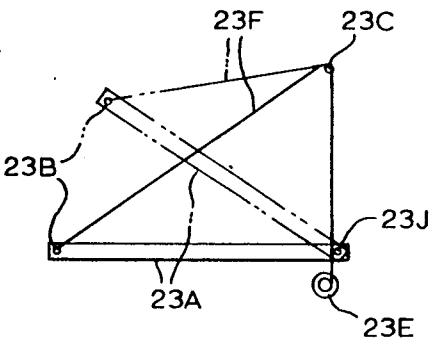
FIG. 8 diagrammatically illustrates a movement of the supply shelf mechanism shown in FIG. 7.

FIG. 7 is a perspective view showing one of the supply shelf mechanisms employed in the display case of the fifth embodiment. A supply shelf mechanism 23 includes a supply shelf body 23A which is constituted of a base 23H and riser walls 23I fixedly attached on both the sides and the rear end of the base 23H. The supply shelf body 23A is pivotally mounted on a pair of the support frame 24 in the front end thereof by a pair of pivots 23J and is normally resting on a pair of the brackets 12. A pair of anchor pins 23B are fixedly attached to both the sides of the supply shelf body 23A in the proximity of the rear end thereof. A pair of idler pulleys 23C are mounted on the support frame 24 at an even level substantially higher than the level of the supply shelf body 23A. A drive shaft 23D is rotatably and horizontally mounted on and across the brackets 12 at an level slightly lower than the level of the supply shelf body 23A. A pair of wind-up pulleys 23E are fixedly mounted on the drive shaft 23D and a bidirectional drive motor 23G is fixedly mounted on one of the brackets 12 and drivably connected to the drive shaft 23D. In reference to FIG. 7 and FIG. 8, a pair of wires 23F are passed by way of the respective idler pulleys 23C and the ends thereof are anchored to the respective anchor pins 23B and the respective wind-up pulleys 23E so that the wind-up pulleys can wind up the wires 23F as the drive shaft 23D is rotated by the drive motor 23G and, consequently, the supply shelf body 23A is rotated about the pivots 23J so as to be made downwardly sloped toward the display shelf 4B. Still referring to FIG. 7, on and across the pair of the support frame 24 is pivotally mounted the partition member 3A which normally covers a supply gate 3C, the opening between the pair of the support frame 24. The partition member 3A has its pivotal mounting axis along the top edge thereof and can be pivotally opened by being pushed frontwardly as mentioned before. Although not shown in the figure, a plurality of the supply shelf mechanisms 23 of identical construction are disposed laterally aligned one another and at a plurality of vertically spaced levels. A total number of the supply shelf mechanisms 23 in the display case is assumed to be "n" for further explanation purposes. Each of the supply shelf mechanisms 23 can be independently operable as explained below.

FIG. 9 shows a block diagram of the control and drive circuit for n number of the drive motors 23G employed in the supply shelf mechanisms 23 of the same number. The circuit includes n number of merchandise detectors 22, a central processing unit (CPU) 25 of a microcomputer, a drive circuit unit 26 and n number of the drive motors 23G. Referring to FIGS. 6 and 9, as the photosensors 22B receive lights transmitted from the respective light emitters 22A, namely, the merchandise detectors 22 detect absent states of the merchandise on the respective display shelves 4B, the respective drive motors 23G are actuated by the control and drive circuit.

FIG. 10 is a program flowchart for controlling n number of the drive motors 23G. When the 1st merchandise detector 22-1 is "OFF" (signifying that merchandise 11 on the corresponding display shelf 4B is absent and the drive switch S1 will, therefore, be "ON"), the corresponding 1st drive motor 23G-1 of the corresponding supply shelf mechanism 23 will be turned on and actuated. Then, as explained in the following paragraph, the corresponding display shelf 4B will receive merchandise and the merchandise detector 22-1 will then be turned to "ON" (signifying that the merchandise is now present) and the drive switch S1 will then be "OFF". Likewise, the presence/absence status of the merchandise by all of the n number of the merchandise detectors 22 are sequentially detected and, finally, when the n-th merchandise detector 22-n is "OFF" (the drive switch Sn will be "ON"), the corresponding n-th drive motor 23G-n will be turned on and actuated.

Referring to FIGS. 7 to 10, with any of the 1st to n-th supply shelf mechanisms 23, as the drive motor 23G is actuated, the actuated motor 23G turns the drive shaft 23D and the windup pulleys 23E. Then, the pair of wires 23F are wound up, thereby causing the supply shelf body 23A to be tilted so as to be downwardly sloped frontwardly. As the supply shelf body 23A is sloped, the merchandise placed thereon will slide down and move frontwardly, thereby pushing and opening the partition member 3A and further moving onto the display shelf 4B past the supply gate 3C. The supply shelf body 23A, then, can be lowered to the rest position by reversely rotating the drive motor 23G, or, alternatively, by manually pressing it down.

Thus, according to the fifth embodiment of the present invention as described above, the merchandise placed on the supply shelf body 23A can automatically be moved to the corresponding display shelf 4B when the corresponding display shelf 4B lacks the merchandise.

Figure 11:
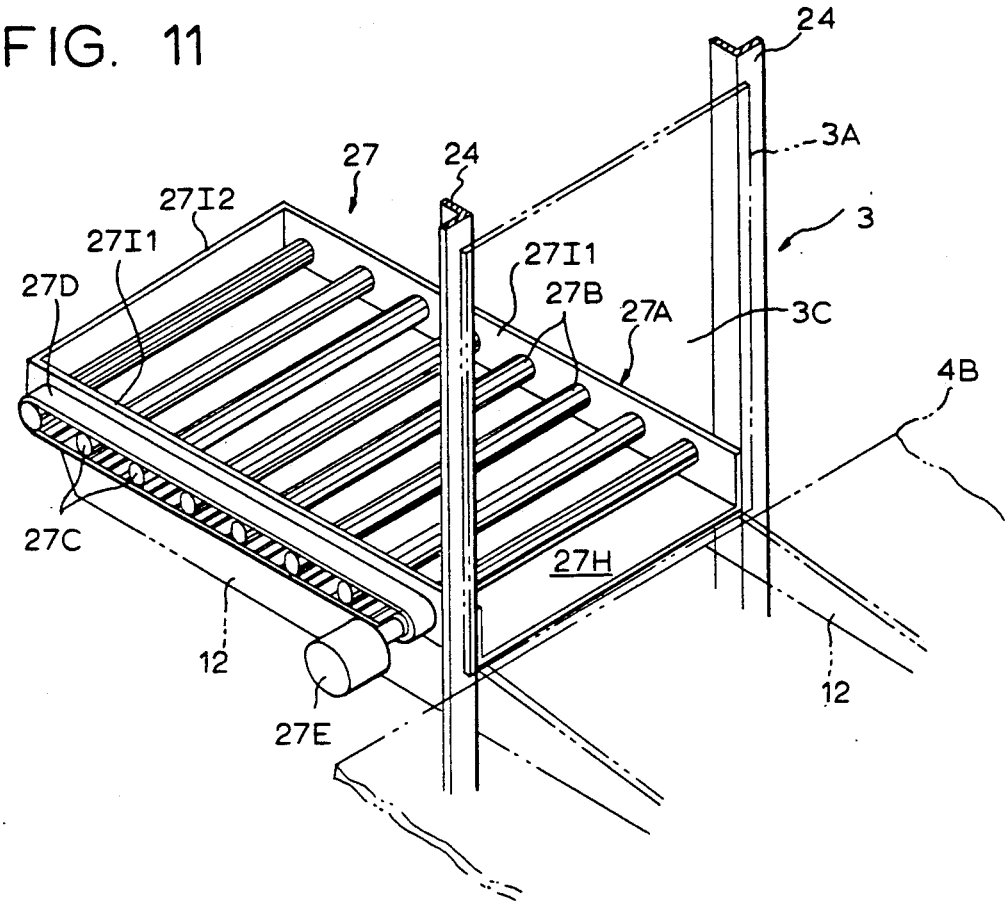
FIG. 11 is a perspective view of a supply shelf unit employed in the sixth embodiment of the display case according to the present invention.

FIG. 11 is a perspective view showing one of the supply shelf units employed in the display case of the sixth embodiment according to the present invention. A supply shelf unit 27, which is disposed on the brackets 12, includes a supply shelf body 27A which is constituted of a base 27H and side riser walls 27I1 and a rear riser wall 27I2 fixedly attached on both sides and the rear end, respectively, of the base 27H. A plurality of parallel and evenly spaced conveyor rollers 27B are rotatably and laterally mounted on and across the side riser walls 27I1. Timing wheels 27C are fixedly mounted on one side of all of the conveyor rollers 27B and all of the timing wheels 27C are engaged with an endless timing belt 27D. A drive motor 27E is mounted on one of the brackets 12 and is drivably connected to one of the timing wheels 27C so that all of the timing wheels 27C and, therefore, all of the conveyor rollers 27B are simultaneously rotated in the clockwise direction (as viewed in FIG. 11) once the drive motor 27E is actuated.

A plurality of the drive motors 27E for the plurality of the supply shelf units 27 can be controlled and driven in the same manner as was explained in the case of the fifth embodiment in reference to FIGS. 9 and 10 except that the drive motors 27E of the sixth embodiment need not be rotated in the reverse direction. In other words, as any of the merchandise detectors 22 senses the absent status of the merchandise on the display shelve 4B, the corresponding drive motor 27E will be actuated and the conveyor rollers 27B will be rotated clockwise (as viewed in FIG. 11), so that the merchandise thereon moves frontwardly, pushing and opening the partition member 3A, onto the display shelve 4B past the supply gate 3C.

Figure 12:
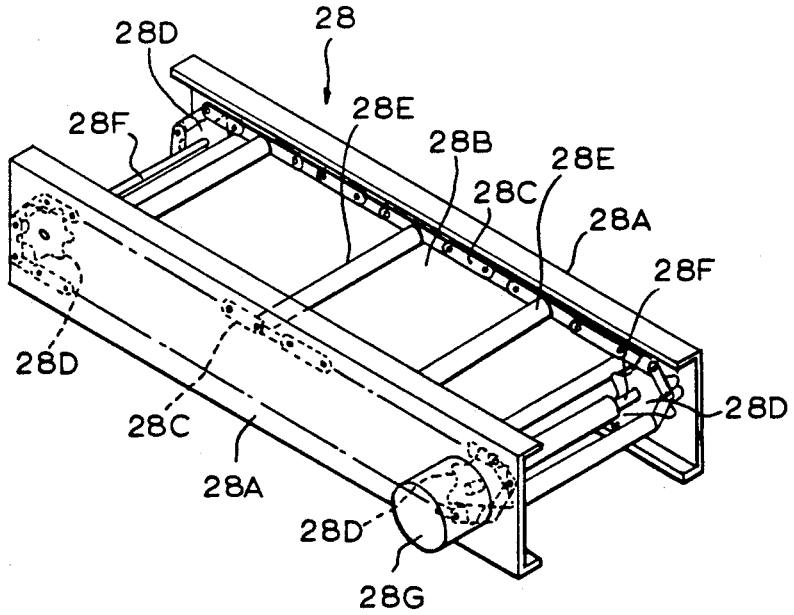
FIG. 12 is a perspective view of a supply shelf unit employed in the seventh embodiment of the display case according to the present invention.
Figure 13:
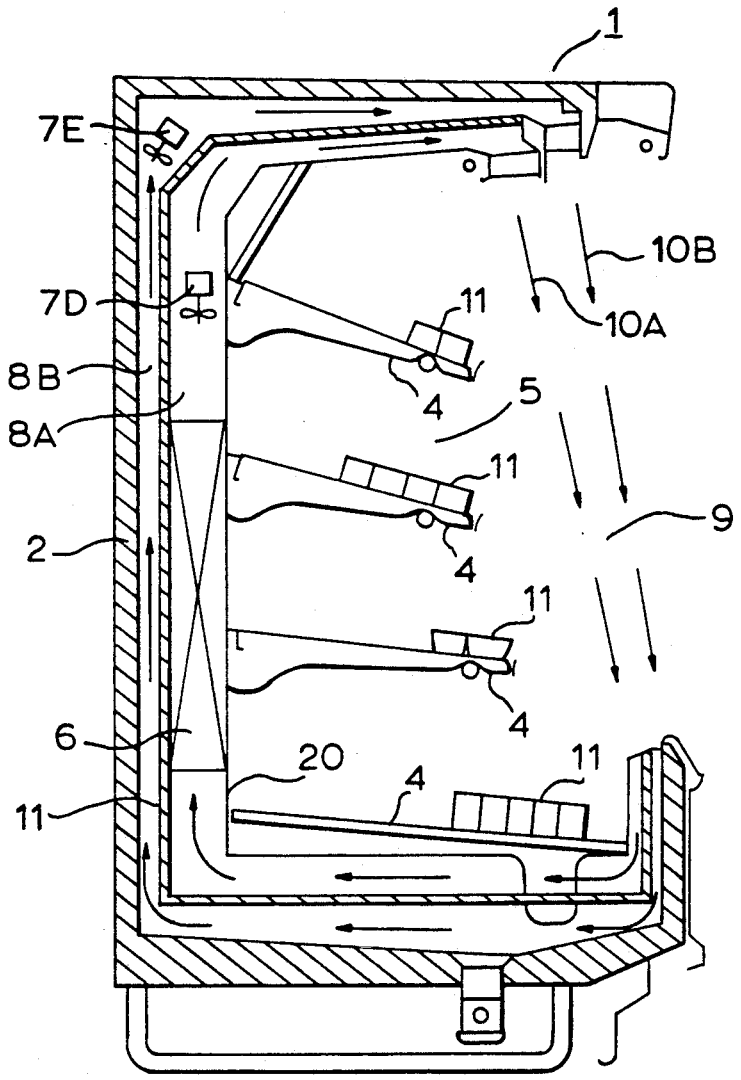
FIG. 13 (PRIOR ART)
FIG. 13 is a side elevational sectional view of a conventional air-conditioned display case.

FIG. 12 is a perspective view showing one of the supply shelf units employed in the display case of the seventh embodiment of the present invention. A supply shelf unit 28 includes a pair of opposing side frames 28A, disposed in parallel with each other, and a loading board 28B interposed between, and fixedly connected to, the side frames 28A. A pair of shafts 28F are rotatably mounted on and across the frames 28A in the proximities of both the ends thereof. A pair of sprockets 28D are fixedly mounted on each of the shafts 28F at positions close to the side frames 28A. A pair of endless chains 28C run in parallel with each other around the loading board 28B, engaging with the sprockets 28D, so that the pair of the shafts 28F are drivably connected each other. Evenly spaced pushrods 28E are laterally mounted on and across the pair of the chains 28D. A drive motor 28G is mounted on one of the side frames 28A and drivably connected to one of the shafts 28F. Thus, once the motor 28G is actuated to rotate the shafts 28F in the clockwise direction (as viewed in FIG. 12), the pushrods 28E will move around the loading board 28B in the same rotating direction and will push and move any merchandise placed on the loading board 28B frontwardly (rightwardly as viewed in FIG. 12) and onto the corresponding display shelf 4B (not shown in FIG. 12) in the same manner as described for the sixth embodiment. The basic function and the control and drive principle of all of the supply shelf units 28 are also the same as those of the of the supply shelf units 27 of the fifth embodiment except that the drive motors 28G need not be reversely rotated.

Referring back to FIGS. 1 to 4, by substituting a heater for the evaporator 6 in the inside air passageway 8A, a warmed-air type display case, as opposed to the refrigerated-air type display case as described in the above embodiments, can also be made as an additional embodiment of the present invention. Furthermore, a single display case may be made a dual-functioning display case by employing both an evaporator and a heater in the inside air passageway 8A, so that the display case can be used either in a refrigerating mode or in a warming mode by using either the evaporator or the heater, respectively.

As described above, the refrigerated display case according to the present invention has two separate inside rooms divided by a partition. One room is a display room on the front side of the partition for displaying the merchandise on display shelves therein having a front access opening through which the shopping customers reach the merchandise. The other room is a supply room on the rear side of the partition having a means for not only supplying the merchandise therefrom onto the display shelves in the display room but also a means for preliminarily storing the merchandise therein. An entry door allows a work personnel to enter the supply room. The work personnel, therefore, can supply merchandise into the display room from the backside of the display room, without using the front access opening and, thus, without interfering with the shopping customers. The innermost (rearmost) parts of the display shelves, which are otherwise difficult to be reached by the work personnel through the front access opening, can be easily loaded with the merchandise from the rear side. Since the supply room can be utilized as a storage room, the conveyance of the merchandise to the display case can be performed in less number of times for a given quantity of merchandise and it can also be planned and practiced more efficiently as compared to the occasion of a conventional display case. Furthermore, the shopping customers tend to pick merchandise in the proximity of the front access opening, but, since the merchandise is supplied frontwardly from the rear side of the display room, an actual FIFO (first-in first-out) flow situation of the merchandise can be realized. In selling perishable foods or the like items, it is ideal that the items placed in the display case earlier sell first.

It will be understood that various changes and modifications may be made in the above described embodiments which provide the characteristics of this invention without departing from the spirit and principle thereof particularly as defined in the following claims.

What is claimed is:

1. An air-conditioned display case comprising:

(a) a housing having an access opening on the front side thereof;

(b) an air passageway in said housing;

(c) means for driving air in said air passageway so as to establish an aircurtain across said access opening;

(d) a heat exchange means disposed in said air passageway for regulating the air temperature therein;

(e) a substantially vertical partition disposed in said housing, said partition having a support frame which is fixed to said housing and a plurality of partition members which can be opened individually;

(f) a display room on the front side of said partition, said display room having said access opening on the front side thereof, said display room further having therein a plurality of display shelves mounted on said support frame and extending from said partition frontwardly in a vertically spaced arrangement; and (g) a supply room on the rear side of said partition, said supply room having a plurality of supply shelves and a closeable entrance, said supply shelves being mounted on said support frame and extending rearwardly from said partition in a vertically spaced arrangement, each at the level of a corresponding display shelf at which said supply shelf and said display shelf are in alignment, each of said partition members corresponding to one of said supply shelves, whereby merchandise brought into said supply room by a work personnel through said entrance can be placed on said supply shelves and be slidingly moved onto said display shelves past said partition.

2. An air-conditioned display case according to claim 1, wherein any of said supply shelves and said display shelves are frontwardly descending so as to facilitate moving merchandise thereon frontwardly.

3. An air-conditioned display case according to claim 1, wherein any of said supply shelves and said display shelves have conveyor rollers so as to facilitate moving merchandise thereon.

4. An air-conditioned display case according to claim 1, further comprising storage shelves in said supply room for preliminarily storing merchandise thereon.

5. An air-conditioned display case according to claim 4, wherein said storage shelves are arranged vertically spaced and one end of each thereof is disposed in the proximity of said closeable entrance.

6. An air-conditioned display case according to claim 5, wherein each of said storage shelves is descending toward said closeable entrance, each of said storage shelves having conveyor rollers and a stopper on said one end so as to facilitate loading merchandise thereon.

7. An air-conditioned display case according to claim 1, wherein said supply room serves as a part of said air passageway.

8. An air-conditioned display case according to claim 1, wherein said air passageway is enclosed by a duct so that said supply room is isolated by said duct from said air passageway.

9. An air-conditioned display case according to claim 1, further comprising in said display room merchandise detectors for detecting absent states of the merchandise on said display shelves individually corresponding to each of said supply shelves.

10. An air-conditioned display case according to claim 9, wherein said supply shelves are pivotally mounted on said partition and can individually be tilted descendingly toward said display shelves so that any merchandise thereon can be slidingly moved toward said display shelves.

11. An air-conditioned display case according to claim 10, further comprising:

(a) actuating mechanisms for tilting said supply shelves individually;

(b) drive means for driving said actuating mechanisms individually; and (c) control means for controlling said drive means so that when said merchandise detectors detect absent states of merchandise on said respective display shelves, said control means causes said drive means to drive said respective actuating mechanisms, thereby tilting said respective supply shelves and causing the merchandise thereon to slidingly move toward said respective display shelves.

12. An air-conditioned display case according to claim 9, wherein each of said supply shelves has conveyor rollers so as to facilitate conveying merchandise thereon toward said display shelves.

13. An air-conditioned display case according to claim 12, further comprising:

(a) actuating mechanisms for rotating said conveyor rollers of said supply shelves individually;

(b) drive means for driving said actuating mechanisms individually; and (c) control means for controlling said drive means so that when said merchandise detectors detect absent states of merchandise on said respective display shelves, said control means causes said drive means to drive said respective actuating mechanisms, thereby rotating said conveyer rollers of said respective supply shelves and causing the merchandise thereon to move toward said respective display shelves.

14. An air-conditioned display case according to claim 9, wherein each of said supply shelves has a pair of opposing side frames disposed in parallel each other, a loading board interposed between, and fixedly connected to, said side frames, a shaft-sprocket mechanism mounted on said side frames, a pair of endless chains disposed in parallel around said loading board and drivably connected to said shaft-sprocket mechanism, and evenly spaced pushrods mounted on and across said pair of endless chains.

15. An air-conditioned display case according to claim 14, which further comprises:

(a) drive means for driving said chains; and (b) control means for controlling said drive means so that when said merchandise detectors detect absent states of merchandise on said respective display shelves, said control means causes said drive means to drive said chains so as to move said pushrods on the top side of said loading board frontwardly, thereby causing the merchandise thereon to move toward said respective display shelves.

16. An air-conditioned display case according to claim 1, wherein said heat exchange means is an evaporator.

17. An air-conditioned display case according to claim 1, wherein said heat exchange means is a heater.

18. An air-conditioned display case comprising:

(a) a housing having an access opening on the front side thereof;

(b) an air passageway in said housing;

(c) means for driving air in said air passageway so as to establish an aircurtain across said access opening;

(d) a heat exchange means disposed in said air passageway for regulating the air temperature therein;

(e) a substantially vertical partition disposed in said housing, said partition having a support frame which is fixed to said housing and a plurality of partition members which are pivotally mounted in the top edges thereof on said support frame so as to be pivotally opened individually;

(f) a plurality of brackets fixedly mounted on said support frame;

(g) a display room on the front side of said partition, said display room having said access opening on the front side thereof, said display room further having therein a plurality of display shelves extending from said partition frontwardly in a vertically spaced arrangement, said display shelves being mounted on said brackets; and (h) a supply room on the rear side of said partition, said supply room having a closeable entrance and a plurality of supply shelves, said supply shelves being mounted on said brackets and extending rearwardly from said partition in a vertically spaced arrangement, each at the level of a corresponding display shelf at which said supply shelf and said display shelf are in alignment, each of said partition members corresponding to one of said supply shelves, whereby merchandise brought into said supply room by a work personnel through said entrance can be placed on said supply shelves and be slidingly moved onto said display shelves past said partition.

19. An air-conditioned display case according to claim 18, wherein said supply room serves as a part of said air passageway.

20. An air-conditioned display case according to claim 18, wherein said air passageway is enclosed by a duct so that said supply room is isolated by said duct from said air passageway.

* * * * *